US011415389B2

(12) United States Patent
Sessions et al.

(10) Patent No.: US 11,415,389 B2
(45) Date of Patent: Aug. 16, 2022

(54) GUNSIGHT WITH PROGRAMMABLE ILLUMINATOR AND TRAINING MODE

(71) Applicants: Julian Sessions, Beaverton, OR (US); Thomas E. Moyle, Hillsboro, OR (US); Frederick A. Azinger, Portland, OR (US); Timothy John Lesser, Sherwood, OR (US)

(72) Inventors: Julian Sessions, Beaverton, OR (US); Thomas E. Moyle, Hillsboro, OR (US); Frederick A. Azinger, Portland, OR (US); Timothy John Lesser, Sherwood, OR (US)

( * ) Notice: Subject to any disclaimer, the term of this patent is extended or adjusted under 35 U.S.C. 154(b) by 0 days.

(21) Appl. No.: 17/150,649

(22) Filed: Jan. 15, 2021

(65) Prior Publication Data

US 2021/0222997 A1 Jul. 22, 2021

Related U.S. Application Data

(60) Provisional application No. 62/962,654, filed on Jan. 17, 2020.

(51) Int. Cl.
*F41G 1/30* (2006.01)
*F41G 1/34* (2006.01)

(52) U.S. Cl.
CPC ..... *F41G 1/30* (2013.01); *F41G 1/345* (2013.01)

(58) Field of Classification Search
CPC ..... F41G 1/30; F41G 1/345
USPC ..... 42/113
See application file for complete search history.

(56) References Cited

U.S. PATENT DOCUMENTS

2011/0297744 A1* 12/2011 Schneider ..... F41G 1/473 235/414
2012/0151816 A1* 6/2012 Kleck ..... F41G 1/30 42/132
2020/0049455 A1* 2/2020 Hamilton ..... F41G 3/165
2021/0207928 A1* 7/2021 Brewer ..... F41G 11/002

* cited by examiner

*Primary Examiner* — Samir Abdosh
(74) *Attorney, Agent, or Firm* — Bennet K. Langlotz; Langlotz Patent & Trademark Works, LLC

(57) ABSTRACT

A reflex sight for a firearm has a body, a mounting facility, a controller, an actuator, and an illumination facility operably connected to the controller and having a plurality of different operating states. The controller is responsive to sequential actuation of the actuator to cycle among the operating states. The controller is operable to change operation of the illumination facility after a selected duration based on a power consumption characteristic of the operating state.

1 Claim, 2 Drawing Sheets

GUNSIGHT WITH PROGRAMMABLE ILLUMINATOR AND TRAINING MODE

CROSS-REFERENCE TO RELATED APPLICATIONS

This application claims the benefit of U.S. Provisional Patent Application No. 62/962,654, filed on Jan. 17, 2020, entitled "Gunsight with Programmable Illuminator and Training Mode", which is hereby incorporated by reference in its entirety for all that is taught and disclosed therein.

FIELD OF THE INVENTION

The present invention relates to a riflescope or other aiming or viewing device that relies on an illuminator or other powered function.

BACKGROUND AND SUMMARY

Traditional riflescopes rely on an illuminator or other powered function.

This illuminator or powered function is subject to power depletion or interruption.

The above disadvantage is addressed by a reflex sight for a firearm which has a body, a mounting facility, a controller, an actuator, and an illumination facility operably connected to the controller and having a plurality of different operating states. The controller is responsive to sequential actuation of the actuator to cycle among the operating states. The controller is operable to change operation of the illumination facility after a selected duration based on a power consumption characteristic of the operating state.

DETAILED DESCRIPTION OF A PREFERRED EMBODIMENT

Figure 1:
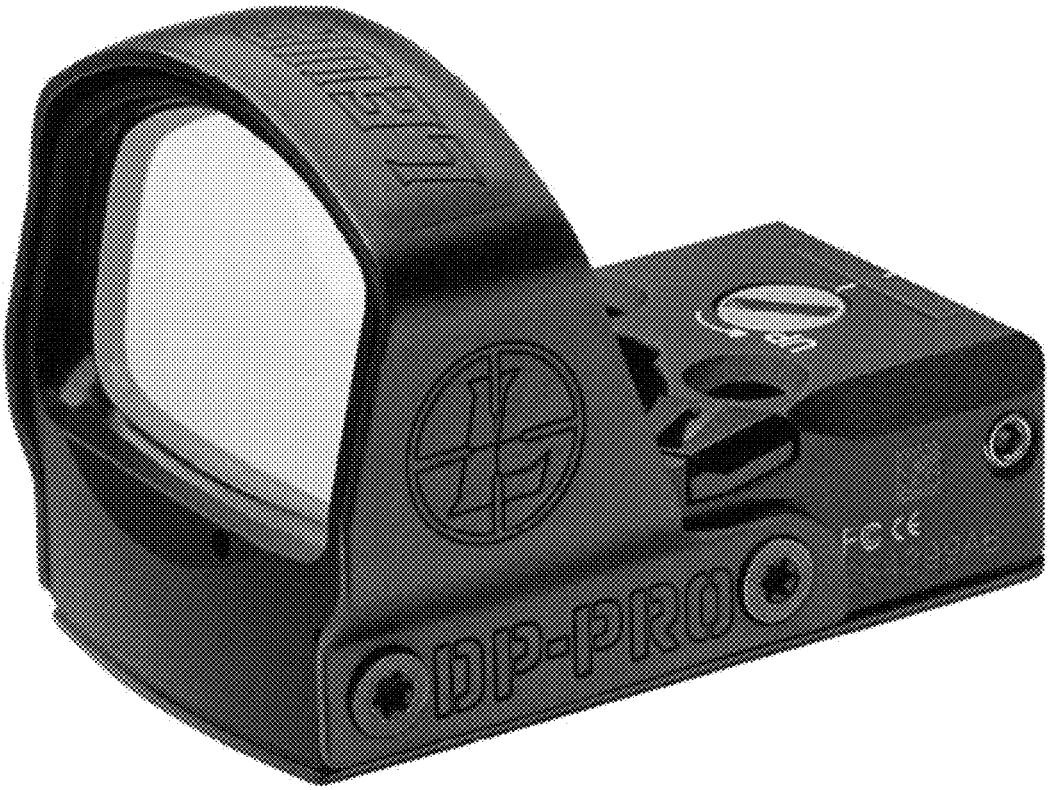
FIG. 1 is a view of the gunsight.
Figure 2:
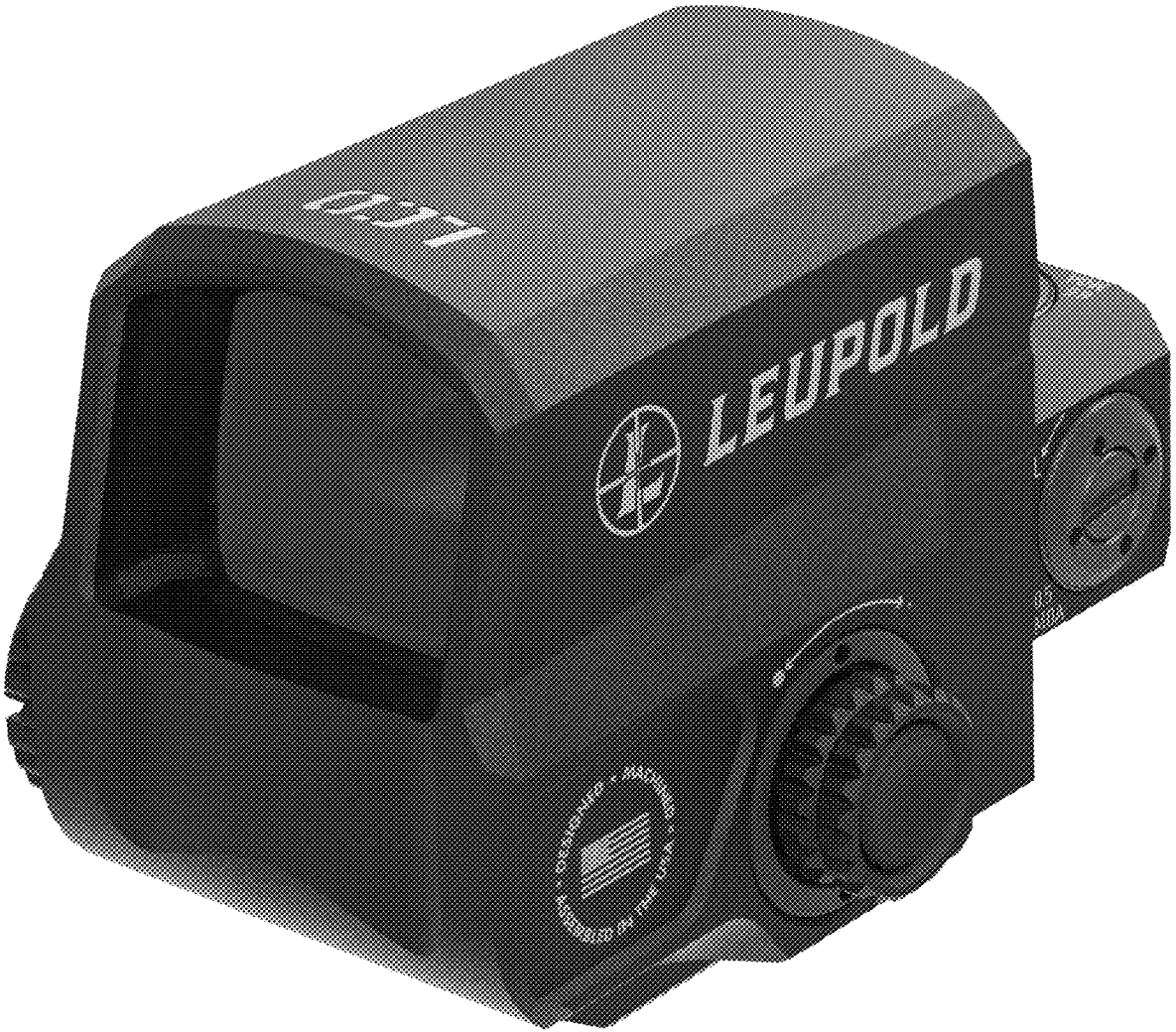
FIG. 2 is a view of the gunsight.

A firearm-mountable reflex or red dot sight that employs conventional optical technology but operates in a manner that includes multiple programmable LED illumination where reference is made to compact reflex sights, the principles may be applied readily to any riflescope or other aiming or viewing device that relies on an illuminator or other powered function that is subject to potential power depletion or interruption.

Multiple illumination levels are made available to the user, and the actual illumination provided by these levels are programmable (All levels could be programmable, but in one preferred embodiment only three are enabled).

The illumination is regulated by the combination of a resistance in series with the LED and pulse width modulation (PWM). Alternatively, one may employ pulse frequency modulation or pure resistive networks to implement illumination. PWM gives an advantage since it is requires few resistors and the PWM frequency is fixed which means LED flicker is predictable.

The preferred embodiment employs a single button interface for simplicity of operation and to provide manufacturing advantages, and timed "button hold" sequences to program the illumination setpoints (each nominally 100%). A button hold distinguishes between brief actuations of the button, and prolonged actuations of different durations, with visual or audible feedback to the user when a duration of hold has been received.

Limits are placed on the brightness setpoints (low limit of 40% and high limit of 250%), so they stay within the realizable range of PWM on a fixed resistor. This may mean that over-driving the LED beyond its rating designed to provide long product life is tolerated controllably for limited durations that do not significantly impair product life or risk failure. In one embodiment, the adjustment is made by altering the PWM duty cycle, however it can also be achieved by other means, such as programmatically combining fixed resistors while not changing the "ON time". The key point being the user programmable mode of operation.

Each brightness setpoint converts to a duty cycle modification factor, which controls the time duration that the LED is lit before being turned off (the "ON" time). The LED is repetitively pulsed for this "ON time" at high rate to avoid flicker. We use approximately 1300 cycles per second. In a preferred embodiment, an abbreviated duration until the automatic shutoff is used for brighter settings to reduce battery depletion, while a longer duration is tolerated for lower power settings.

Storage for the programmable levels is implemented in non-volatile memory so programmable levels can be recalled when the battery is changed after an interval when no power is provided to the memory circuitry.

Optimally, the number of illumination levels may be set at any number, including one. For example, the preferred embodiment has 10 levels. However, a user may want only four. Using button control input, the user could remove levels, and set the illumination precisely where the user would like those 4 levels to be set, so user could arrive the desired setting without needing to cycle through any undesired "factory" illumination levels. This simplifies user operation to select from among a limited number of useful levels without the added time and effort of bypassing selections that are never needed.

The reflex sight can also be set to 'training mode' that causes random shut offs to simulate failure, requiring the user to transition to back-up sights, iron sights, etc. mid-shot. This mode is selected by user input, and may be accompanied by a warning indicator (e.g. illuminator flicker, second warning light, periodic audible alarm) that helps ensure that user does not leave the device in prone-to-fail mode when the user is relying on the device during normal operation. One warning alternative may be an automatic reversion to normal mode after a suitable interval (perhaps an hour) that allows for training. A remote transducer employing wireless technology (e.g. wi-fi, Bluetooth) may connect to a network that enables external control of the device, specifically external ability to "fail" the reflex sight illuminator for training purposes. Specifically, an instructor or a system administering an exercise may cause an individual user's (or all those engaged in a group exercise or parallel training) sight to fail to train and test for adaptation to failure.

The 'trainer' mode can also be accomplished by adding or dedicating a replaceable module that has a code to randomly generate the failure mode scenario. The module randomly generates the failure/recover and repeats at random intervals. The future path would then transition to the Bluetooth solution mentioned.

We claim:

1. A reflex sight for a firearm comprising:

a body;

a mounting facility;

a controller;

an actuator;

an illumination facility operably connected to the controller and having a plurality of different operating states;

wherein one of the operating states is a training mode that causes random shut offs to simulate failure;

the controller responsive to sequential actuation of the actuator to cycle among the operating states; and the controller operable to change operation of the illumination facility after a selected duration based on a power consumption characteristic of the operating state.

* * * * *